US008714123B2

(12) United States Patent
Rollinger et al.

(10) Patent No.: US 8,714,123 B2
(45) Date of Patent: May 6, 2014

(54) OIL PRESSURE MODIFICATION FOR VARIABLE CAM TIMING

(75) Inventors: John Eric Rollinger, Sterling Heights, MI (US); Mohammad Farid, London (GB); David Karl Bidner, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 149 days.

(21) Appl. No.: 13/353,078

(22) Filed: Jan. 18, 2012

(65) Prior Publication Data

US 2013/0180480 A1 Jul. 18, 2013

(51) Int. Cl.
*F01L 1/34* (2006.01)
*G06F 17/00* (2006.01)

(52) U.S. Cl.
USPC ..... 123/90.17; 701/105

(58) Field of Classification Search
USPC ..... 123/90.15–90.18; 701/103, 105, 106, 701/114, 115
See application file for complete search history.

(56) References Cited

U.S. PATENT DOCUMENTS

| | | | | |
|---|---|---|---|---|
| 6,330,870 | B1 * | 12/2001 | Inoue et al. | 123/90.17 |
| 6,386,158 | B1 * | 5/2002 | Takahashi | 123/90.15 |
| 6,739,298 | B2 * | 5/2004 | Kusano et al. | 123/90.17 |
| 6,758,177 | B1 * | 7/2004 | McKay et al. | 123/90.15 |
| 7,188,593 | B2 * | 3/2007 | Iwase et al. | 123/90.15 |
| 7,827,947 | B2 * | 11/2010 | Ichinosawa et al. | 123/90.17 |
| 2001/0039931 | A1 * | 11/2001 | Ogawa | 123/90.17 |
| 2002/0059909 | A1 | 5/2002 | Takahashi | |
| 2002/0139345 | A1 | 10/2002 | Takahara et al. | |
| 2003/0196628 | A1 | 10/2003 | Smith | |
| 2004/0020452 | A1 | 2/2004 | Park | |
| 2006/0027197 | A1 * | 2/2006 | Tagami et al. | 123/90.17 |
| 2006/0124091 | A1 | 6/2006 | Shikata et al. | |
| 2006/0249108 | A1 * | 11/2006 | Lewis et al. | 123/90.15 |
| 2007/0028874 | A1 * | 2/2007 | Simpson | 123/90.15 |
| 2007/0275819 | A1 | 11/2007 | Hirata | |
| 2008/0121464 | A1 | 5/2008 | Ledger et al. | |
| 2008/0135004 | A1 * | 6/2008 | Simpson et al. | 123/90.17 |
| 2008/0228373 | A1 | 9/2008 | Akimoto | |
| 2009/0205889 | A1 * | 8/2009 | Leone | 180/65.265 |
| 2009/0223472 | A1 * | 9/2009 | Cinpinski et al. | 123/90.17 |
| 2010/0147256 | A1 | 6/2010 | Takahashi | |
| 2011/0023805 | A1 | 2/2011 | Takemura | |
| 2011/0061619 | A1 | 3/2011 | Urushihata | |

* cited by examiner

OTHER PUBLICATIONS

Rollinger, John Eric et al., "Oil Pressure Scheduling Based on Engine Acceleration," U.S. Appl. No. 13/362,858, filed Jan. 31, 2012, 25 pages.

Grieser, Klemens et al., "Method and Device for Operating a Lubricating System of a Combustion Engine," U.S. Appl. No. 13/740,098, filed Jan. 11, 2013, 21 pages.

*Primary Examiner* — Thomas Denion
*Assistant Examiner* — Steven D Shipe
(74) *Attorney, Agent, or Firm* — Julia Voutyras; Alleman Hall McCoy Russell & Tuttle LLP

(57) ABSTRACT

Systems and methods for modifying oil pressure for a variable cam timing system are provided. In one example approach, a method comprises, in response to an operating condition, adjusting a valve coupled to a hydraulic variable camshaft timing actuator to initiate camshaft phasing and adjusting an oil pressure supplied to the valve based on a camshaft phaser position. If a camshaft phaser locking pin is in a home position, the method may further comprise reducing the oil pressure supplied to the valve for a predetermined time interval to a threshold amount to unlock the locking pin but not move the camshaft phaser and then increasing the oil pressure supplied to the valve to move the camshaft phaser.

19 Claims, 5 Drawing Sheets

OIL PRESSURE MODIFICATION FOR VARIABLE CAM TIMING

FIELD

The present application relates to methods for operating an engine with variable cam timing (VCT).

BACKGROUND AND SUMMARY

Internal combustion engines may use variable cam timing (VCT) to improve fuel economy and emissions performance of a vehicle. One method of variable cam timing uses an Oil Pressure Actuated device (OPA), such as a vane type cam phaser. The phaser may be controlled by an electromechanically actuated spool valve that directs oil flow to one side or the other of the vane. The performance of this device is thus dependent on oil pressure, which may be set lower for fuel economy or to reduce parasitic loads under nominal conditions.

The inventors herein have recognized that under certain conditions, VCT phasers may not reach a desired position, e.g., when camshaft phaser temperatures are higher than the oil sump temperature or when the VCT phasers are worn. Further, this condition may be exasperated when the oil pressure is set lower for fuel economy or to reduce parasitic loads. Reduced oil pressure may also reduce the phasing velocity of VCT phasers which may negatively affect engine response, turbo spool up time, and the ability to meet optimal Brake Specific Fuel Consumption due to engine breathing, for example.

In some examples, VCT phasers are equipped with a locking pin in their home position to prevent rattle noise. These pins may be pushed out the by the same oil that moves the cams. However, there is a race condition when the cams are first commanded to move so that if the cam moves first it may jam the pin in the locked position preventing further movement of the cam.

In one example approach, to at least partially address these issues, an engine method is provided. The method comprises, in response to an operating condition, adjusting a valve coupled to a hydraulic variable camshaft timing actuator to initiate camshaft phasing and adjusting an oil pressure supplied to the valve based on a camshaft phaser position. In some examples, if a camshaft phaser locking pin is in a home position, the method may further comprise reducing the oil pressure supplied to the valve for a predetermined time interval to a threshold amount to unlock the locking pin but not move the camshaft phaser and then increasing the oil pressure supplied to the valve to move the camshaft phaser.

In this way, oil pressure may be boosted when the phasing position in not achieved so that a pump (e.g., a Variable Oil Pump (VOP)) output is increased to help push the cams to a desired position. Further, the amount of oil pressure compensation may be proactive and reactive. For example, the error may be saved in a weighted additive manner for future use and may be used to estimate an age of the VCT phasers. Additionally, the VCT pin unlocking can be made more controllable by reducing the oil pressure to a pressure that the pin preferentially reacts and the cam phaser does not. Further, since the oil pressure may be set lower while still achieving VCT control and increased during select conditions when needed by the VCT system, fuel economy may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 3:
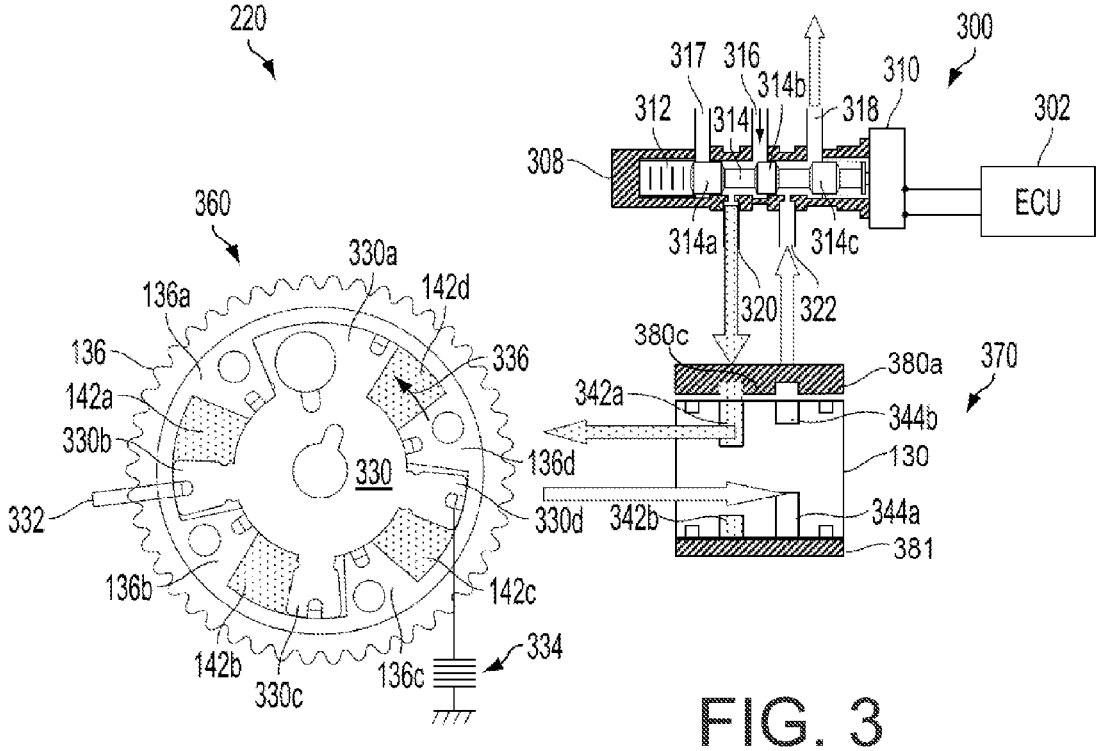
FIG. 3 shows an example VCT phaser and hydraulic system.
Figure 4:
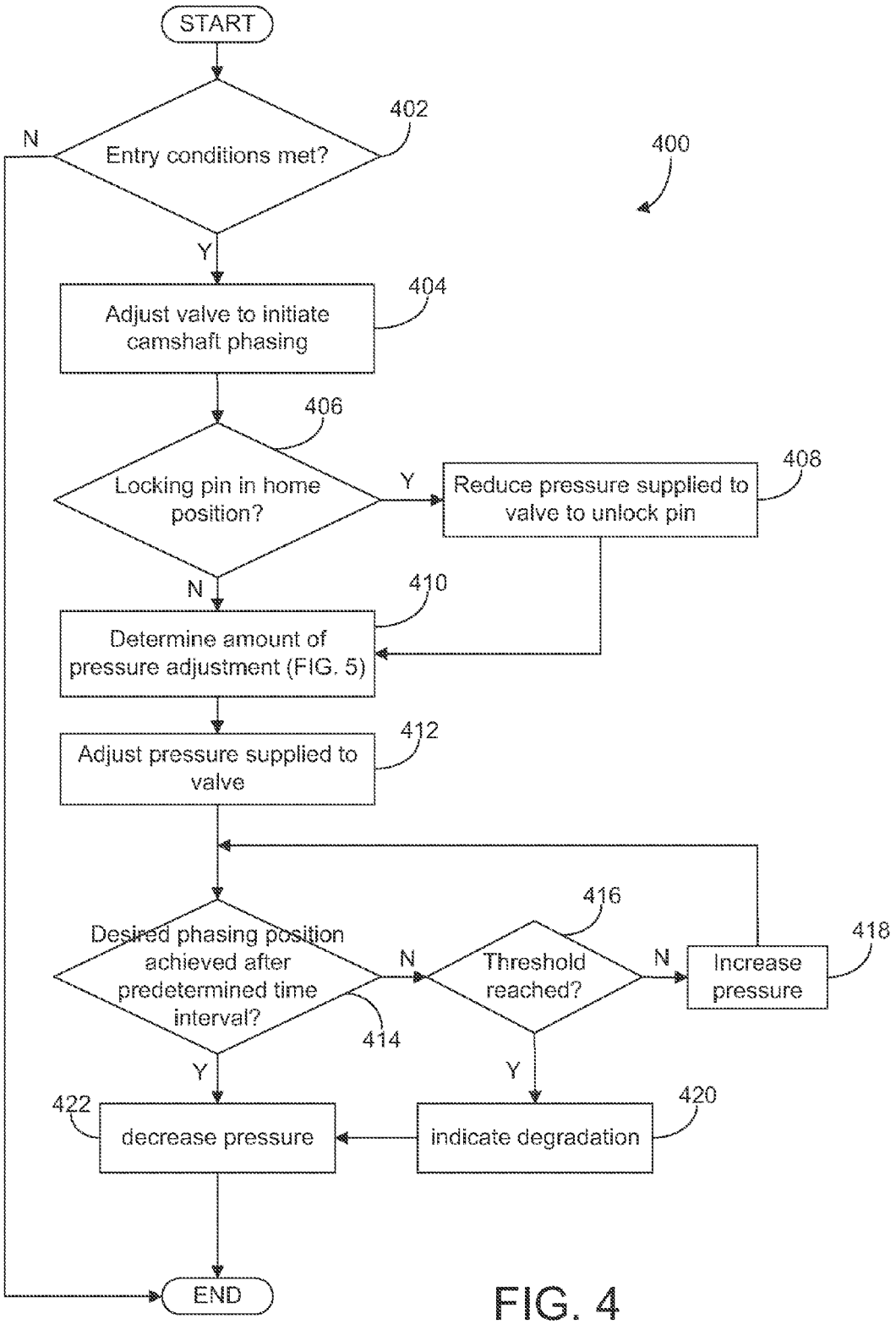
FIG. 4 shows an example method for modifying oil pressure supplied to a variable valve timing system in accordance with the disclosure.

The following description relates to systems and methods for controlling an engine of a vehicle, the engine having a variable cylinder valve system, such as a variable cam timing (VCT). For example, the engine (such as the one illustrated in FIG. 1) may include a VCT phaser to adjust the cam timing (such as, an amount of cam retard or cam advance), where the phaser is included in a hydraulic system (such as described in FIG. 2). Further, the engine may include a corresponding hydraulic control system having a spool valve, as illustrated in FIG. 3. An amount of oil supplied to the VCT phasers may be adjusted using a control algorithm, such as shown in FIG. 4, to push a phaser into a desired position and/or increase a phasing velocity of a phaser during a phasing event. In some examples, the amount of oil pressure compensation may be based on a desired, actual and modeled phasing rate as shown in the example method in FIG. 5.

Figure 1:
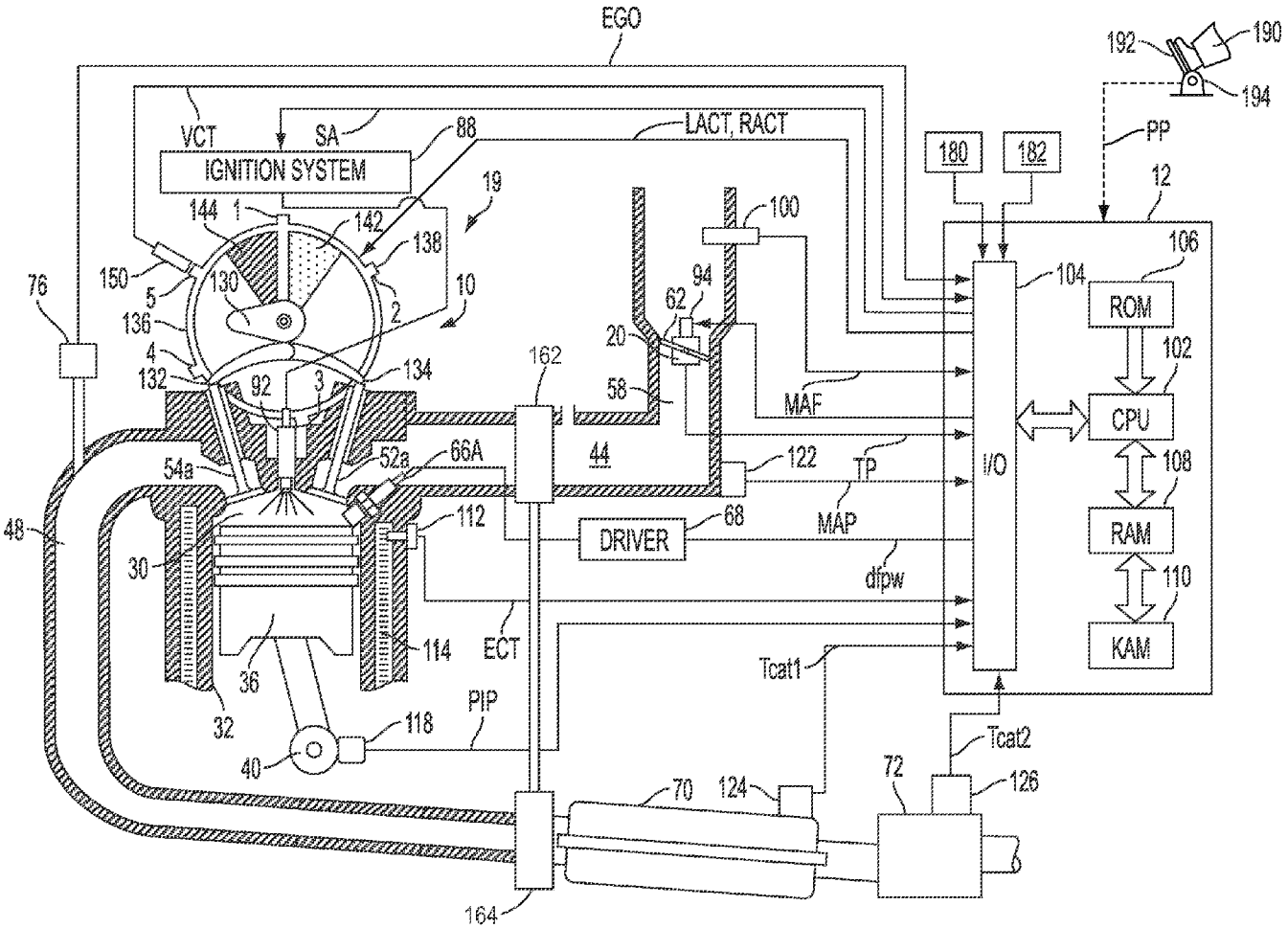
FIG. 1 shows a partial engine and related systems view.

FIG. 1 depicts an example embodiment of a combustion chamber or cylinder of internal combustion engine 10. FIG. 1 shows that engine 10 may receive control parameters from a control system including controller 12, as well as input from a vehicle operator 190 via an input device 192. In this example, input device 192 includes an accelerator pedal and a pedal position sensor 194 for generating a proportional pedal position signal PP.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10. Crankshaft 40 is coupled to oil pump 208 to pressurize the engine oil lubrication system 200 (the coupling of crankshaft 40 to oil pump 208 is not shown). Housing 136 is hydraulically coupled to crankshaft 40 via a timing chain or belt (not shown). Oil pump 208 may be adjusted to increase or decrease oil pressure.

Cylinder 30 can receive intake air via intake manifold or air passages 44. Intake air passage 44 can communicate with other cylinders of engine 10 in addition to cylinder 30. In some embodiments, one or more of the intake passages may include a boosting device such as a turbocharger or a supercharger. A throttle system including a throttle plate 62 may be provided along an intake passage of the engine for varying the flow rate and/or pressure of intake air provided to the engine cylinders. In this particular example, throttle plate 62 is coupled to electric motor 94 so that the position of elliptical throttle plate 62 is controlled by controller 12 via electric motor 94. This configuration may be referred to as electronic throttle control (ETC), which can also be utilized during idle speed control.

Combustion chamber 30 is shown communicating with intake manifold 44 and exhaust manifold 48 via respective intake valves 52*a* and 52*b* (not shown), and exhaust valves 54*a* and 54*b* (not shown). Thus, while four valves per cylinder may be used, in another example, a single intake and single exhaust valve per cylinder may also be used. In still another example, two intake valves and one exhaust valve per cylinder may be used.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30.

Engine 10 may further include a compression device such as a turbocharger or supercharger including at least a compressor 162 arranged along compressor passage 44, which may include a boost sensor for measuring air pressure. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 62; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 20; absolute Manifold Pressure Signal MAP from sensor 122; an indication of knock from knock sensor 182; and an indication of absolute or relative ambient humidity from sensor 180. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft.

In this particular example, temperature $T_{cat1}$ of catalytic converter 70 is provided by temperature sensor 124 and temperature $T_{cat2}$ of emission control device 72 is provided by temperature sensor 126. In an alternate embodiment, temperature Tcat1 and temperature Tcat2 may be inferred from engine operation.

Continuing with FIG. 1, a variable camshaft timing (VCT) system 19 is shown. In this example, an overhead cam system is illustrated, although other approaches may be used Specifically, camshaft 130 of engine 10 is shown communicating with rocker arms 132 and 134 for actuating intake valves 52*a*, 52*b* and exhaust valves 54*a*, 54*b*. VCT system 19 may be oil-pressure actuated (OPA), cam-torque actuated (CTA), or a combination thereof. By adjusting a plurality of hydraulic valves to thereby direct a hydraulic fluid, such as engine oil, into the cavity (such as an advance chamber or a retard chamber) of a camshaft phaser, valve timing may be changed, that is advanced or retarded. As further elaborated herein, the operation of the hydraulic control valves may be controlled by respective control solenoids. Specifically, an engine controller may transmit a signal to the solenoids to move a valve spool that regulates the flow of oil through the phaser cavity. As used herein, advance and retard of cam timing refer to relative cam timings, in that a fully advanced position may still provide a retarded intake valve opening with regard to top dead center, as just an example.

Camshaft 130 is hydraulically coupled to housing 136. Housing 136 forms a toothed wheel having a plurality of teeth 138. In the example embodiment, housing 136 is mechanically coupled to crankshaft 40 via a timing chain or belt (not shown). Therefore, housing 136 and camshaft 130 rotate at a speed substantially equivalent to each other and synchronous to the crankshaft. In an alternate embodiment, as in a four stroke engine, for example, housing 136 and crankshaft 40 may be mechanically coupled to camshaft 130 such that housing 136 and crankshaft 40 may synchronously rotate at a speed different than camshaft 130 (e.g. a 2:1 ratio, where the crankshaft rotates at twice the speed of the camshaft). In the alternate embodiment, teeth 138 may be mechanically coupled to camshaft 130. By manipulation of the hydraulic coupling as described herein, the relative position of camshaft 130 to crankshaft 40 can be varied by hydraulic pressures in retard chamber 142 and advance chamber 144 (not shown in FIG. 3, but shown in FIG. 1). By allowing high pressure hydraulic fluid to enter retard chamber 142, the relative relationship between camshaft 130 and crankshaft 40 is retarded. Thus, intake valves 52*a*, 52*b* and exhaust valves 54*a*, 54*b* open and close at a time earlier than normal relative to crankshaft 40. Similarly, by allowing high pressure hydraulic fluid to enter advance chamber 144, the relative relationship between camshaft 130 and crankshaft 40 is advanced. Thus, intake valves 52*a*, 52*b*, and exhaust valves 54*a*, 54*b* open and close at a time later than normal relative to crankshaft 40.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valvetrain may be roller finger follower, direct acting mechanical bucket, electrohydraulic, or other alternatives to rocker arms.

Continuing with the variable cam timing system, teeth 138, rotating synchronously with camshaft 130, allow for measurement of relative cam position via cam timing sensor 150 providing signal VCT to controller 12. Teeth 1, 2, 3, and 4 may be used for measurement of cam timing and are equally spaced (for example, in a V-8 dual bank engine, spaced 90 degrees apart from one another) while tooth 5 may be used for cylinder identification. In addition, controller 12 sends control signals (LACT, RACT) to conventional solenoid valves (not shown) to control the flow of hydraulic fluid either into retard chamber 142, advance chamber 144, or neither.

Relative cam timing can be measured in a variety of ways. In general terms, the time, or rotation angle, between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

As described above, FIG. 1 merely shows one cylinder of a multi-cylinder engine, and that each cylinder has its own set of intake/exhaust valves, fuel injectors, spark plugs, etc.

Figure 2:
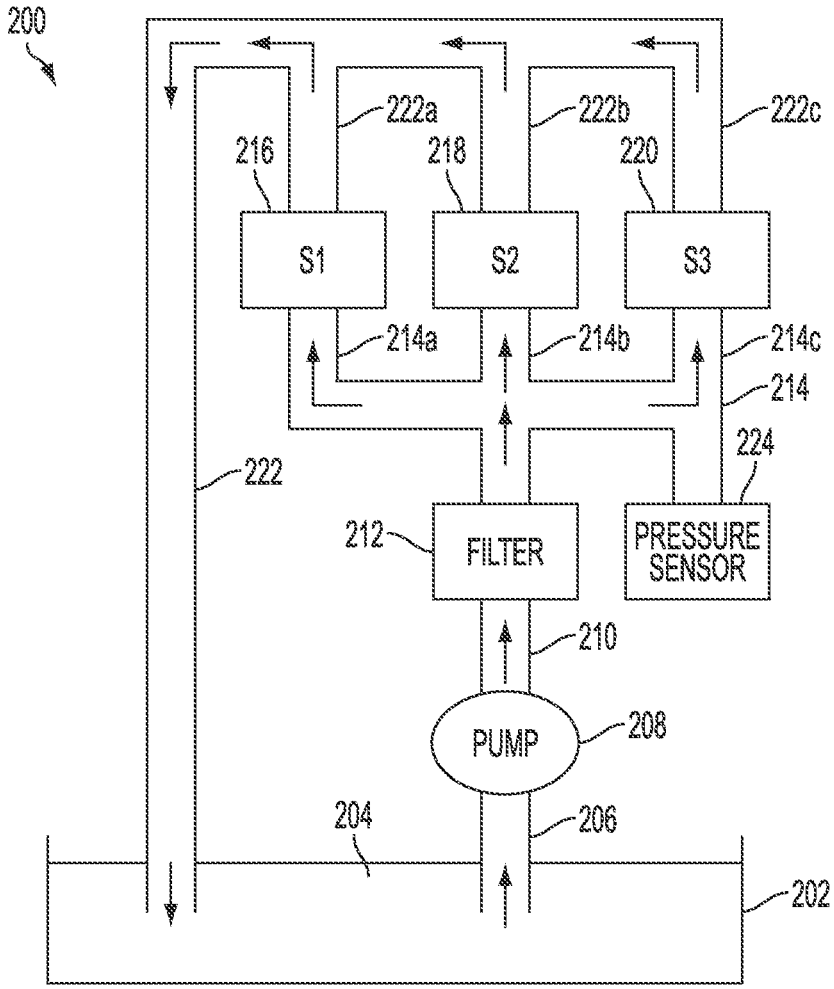
FIG. 2 shows a block diagram of an engine oil lubrication system.

FIG. 2 shows an example embodiment of an engine oil lubrication system 200 with an oil pump 208 coupled to crankshaft 40 (not shown), and including various oil subsystems 216, 218, 220. The oil subsystem may utilize oil flow to perform some function, such as lubrication, actuation of an actuator, etc. For example, one or more of the oil subsystems 216, 218, 220 may be hydraulic systems with hydraulic actuators and hydraulic control valves. Further, the oil subsystems 216, 218, 220 may be lubrication systems, such as passageways for delivering oil to moving components, such as the camshafts, cylinder valves, etc. Still further non-limiting examples of oil subsystems are camshaft phasers, cylinder walls, miscellaneous bearings, etc.

Oil is supplied to the oil subsystem through a supply channel and oil is returned through a return channel. In some embodiments, there may be fewer or more oil subsystems.

Continuing with FIG. 2, the oil pump 208, in association with the rotation of crankshaft 40 (not shown), sucks oil from oil reservoir 204, stored in oil pan 202, through supply channel 206. Oil is delivered from oil pump 208 with pressure through supply channel 210 and oil filter 212 to main galley 214. The pressure within the main galley 214 is a function of the force produced by oil pump 208 and the flow of oil entering each oil subsystem 216, 218, 220 through supply channels 214*a*, 214*b*, 214*c*, respectively. Oil returns to oil reservoir 204 at atmospheric pressure through return channel 222. Oil pressure sensor 224 measures main galley oil pressure and sends the pressure data to controller 12 (not shown). Pressure within the main galley may be increased or decreased by respectively increasing or decreasing the force produced by oil pump 208 in response to signals received from controller 12, for example.

The level of the main galley oil pressure can affect the performance of one or more of the oil subsystems 216, 218, 220, for example the force generated by a hydraulic actuator is directly proportional to the oil pressure in the main galley. When oil pressure is high, the actuator may be more responsive; when oil pressure is low, the actuator may be less responsive. Low oil pressure may also limit the effectiveness of engine oil to lubricate moving components. For example, if the main galley oil pressure is below a threshold pressure, a reduced flow of lubricating oil may be delivered, and component degradation may occur.

FIG. 3 shows an example oil subsystem 220. Oil subsystem 220 (herein also "phaser") is comprised of variable cam timing actuator (herein also "actuator") 360, variable force solenoid (herein also "solenoid") 310, oil control spool valve (herein also "spool valve") 300, cam journal 370, and hydraulic channels (herein also "channels") 316, 317, 318, 320, 322. Channel 316 connects main galley 214 to spool valve 300; channels 317, 318 connect spool valve 300 to return channel 222; channel 320 connects spool valve 300 to retard chamber 142 in actuator 360 via cam journal passage 342; channel 322 connects spool valve 300 to advance chamber 144 in actuator 360 via cam journal passage 344. Cam journal 370 includes camshaft 130, cam journal passages 342 and 344, cam journal cap 380, and cylinder head cam bore 381. Cam journal cap 380, mechanically coupled to the cylinder head (not shown), forms a cylindrical bearing within which camshaft 130 may rotate. In FIG. 3, a cut-away view of cam journal cap 380 is shown with cap top 380*a*, cylinder head cam bore 381, and cap seal landing 380*c*. Oil passages may be integrated into cam journal cap 380 as shown on either side of cap seal landing 380*c*. Cam journal passage 342 provides a hydraulic channel for oil between channel 320 and retard chamber 142. Cam journal passage 344 provides a hydraulic channel for oil between channel 322 and advance chamber 144. Cap seal landing 380*c* provides separation between cam journal passages 342 and 344. Thus, in one particular example, a cam-fed oil pressure actuated system may be used.

Actuator 360 is comprised of rotor 330, housing 136, retard chamber 142, advance chamber 144 (not shown), locking pin 332, and optional return spring 334. Rotor 330 is attached to camshaft 130 so it rotates at the same speed as camshaft 130. Rotor 330 is hydraulically coupled to housing 136. Phaser vanes 330*a*, 330*b*, 330*c*, 330*d* move within the recesses formed by retard chamber 142 and advance chamber 144. Spool valve 300 allows rotor 330 to move, by permitting oil flow into retard chamber 142 and out of advance chamber 144 or vice versa, depending on the desired direction of movement (that is, depending on whether a cam advance or a cam retard is desired). During a cam retard, oil from supply channel 316 flows through spool valve 300 and channel 320 and cam journal passage 342 into retard chamber 142 while oil is pushed from advance chamber 144 into cam journal passage 344 and channel 322 through spool valve 300 and out channel 318. During a cam advance, oil from supply channel 316 flows through spool valve 300 and channel 322 and cam journal passage 344 into advance chamber 144 while oil is pushed from retard chamber 142 into cam journal passage 342 and channel 320 through spool valve 300 and out channel 317. Housing 136 forms a mechanical stop for rotor 330. When retard chamber 142 is maximally open and rotor 330 is resting against housing 136, actuator 360 is at the retard end position (herein also "base position") and cam timing is maximally retarded. When advance chamber 144 is maximally open and rotor 330 is resting against housing 136, actuator 360 is at the advance end position and cam timing is maximally advanced. Optional return spring 334 and locking pin 332 may hold rotor 330 in the base position when oil pressure is low, such as during cold start. As oil pressure increases, locking pin 332 can be retracted so rotor 330 is free to move as described previously. When return spring 334 is present, return spring 334 generates a force that biases rotor 330 toward the base position regardless of oil pressure.

Spool valve 300 is comprised of a sleeve 308 for receiving a spool 314 with spool lands 314*a*, 314*b*, 314*c* and a biasing spring 312. Solenoid 310, controlled by electronic control unit (ECU) 302 (which may be controller 12), moves spool 314 within sleeve 308. The position of spool 314 is determined by balancing the force of biasing spring 312 against the force generated by solenoid 310. Spool landings 314*a*, 314*b*, 314*c* are used to restrict or block the flow of oil through the hydraulic channels. Spool 314 can be adjustable such that spool valve 300 operates among a plurality of ranges including a first range generating a hydraulic force in a first direction on the actuator toward a first end position, a second range generating a hydraulic force in a second, opposite direction on the actuator toward a second, opposite end, position, and a neutral range between the first and second ranges. In one example, the first range is a retard range, and the second range is an advancing range.

In the retarding range, oil flows from spool valve 300 into retard chamber 142 forcing actuator 360 to retard cam timing, up to the maximally retarded cam timing. Spool landing 314*a* blocks channel 317, a channel is open from channel 316 to channel 320 between spool landings 314*a*, 314*b*, and a channel is open from channel 322 to channel 318 between spool landings 314*b*, 314*c*. One case of the retarding range is when solenoid 310 is not energized (e.g. has no current applied to it) and actuator 360 is at the base position. In the advancing range, oil flows from spool valve 300 into advance chamber 144 forcing actuator 360 to overcome return spring 334 and advance cam timing, up to the maximally advanced cam timing. Spool landing 314*c* blocks channel 318, a channel is open from channel 316 to channel 322 between spool landings 314*b*, 314*c*, and a channel is open from channel 320 to channel 317 between spool landings 314*a*, 314*b* in the advancing range. In the neutral range, hydraulic forces on the actuator are substantially balanced so actuator 360 will neither advance nor retard cam timing. Torque from return spring 334 is countered by a positive pressure differential from advance chamber 144 to retard chamber 142. In the neutral range, spool landing 314*c* blocks channel 318, a weak channel is open from channel 316 to channel 322 between spool landings 314*b*, 314*c*, and a weak channel is open from channel 320 to channel 317 between spool landings 314*a*, 314*b*.

FIG. 4 shows an example method 400 for modifying oil pressure in an engine oil lubrication system, e.g., lubrication system 200, supplying oil to a camshaft phaser, e.g., phaser 220.

At 402, method 400 includes determining if entry conditions are met for initiating an adjustment of camshaft timing. For example, controller 12 may initiate an adjustment of camshaft timing depending on factors such as engine load and engine RPM. Thus, entry conditions may include an engine RPM or engine load at a threshold value. As other examples, entry conditions may be based on barometric pressure, a driver-demanded torque (for example, from a pedal-position sensor), manifold pressure (MAP), manifold air flow (MAF), an approximate amount of residuals left over in the cylinder(s) from the previous combustion cycle, engine temperature, air temperature, knock limits, etc. . . .

If entry conditions are met at 402, method 400 proceeds to 404. At 404, method 400 includes adjusting a valve coupled to a hydraulic variable camshaft timing actuator to initiate camshaft phasing. For example, the adjusted valve may be a hydraulic spool valve, e.g., spool valve 300, and adjusting the valve may include sending a control signal to a solenoid coupled to the hydraulic spool valve. As described above, adjusting the spool valve in the phaser causes oil from engine oil lubrication system 200 to initiate movement of the phaser to adjust camshaft timing.

As remarked above, if a VCT phaser is in a home position with a locking pin in place, the same oil that pushes the cam may be used to unlock the locking pin. In some examples, under certain conditions, the oil pressure supplied to the phaser may cause the cam to move before the locking pin is unlocked which results in the locking pin becoming jammed in place preventing further movement of the cam phaser. Thus, at 406, method 400 includes determining if a locking pin is in a home position so that oil pressure may be reduced to unlock the locking pin before causing the cam to move.

If, the locking pin is in a home position at 406, method 400 proceeds to 408. At 408, method 400 includes reducing the oil pressure supplied to the valve for a predetermined time interval to a threshold amount to unlock the locking pin but not move the camshaft phaser. In this way, a temporary oil pressure reduction may unlock the locking pin while not causing the phaser to move in order to prevent the locking pin from becoming jammed in place. The threshold amount and time interval for reduced pressure may be based on a variety of factors including an area of the locking pin, a locking pin spring rate, an area of a camshaft phaser, a camshaft phaser spring rate, and a coefficient of camshaft friction.

The amount that the oil pressure is reduced may depend on a current pressure reading in the engine oil lubrication system 200. For example, under certain conditions, oil pressure in the engine lubrication system may be lower due to oil consumption by other oil subsystems.

If the locking pin is not in a home position at 406 or the locking pin is unlocked at 408, then method 400 proceeds to 410. At 410, method 400 includes adjusting the oil pressure in the engine oil lubrication system to adjust the amount of oil pressure supplied to the spool valve. For example, as remarked above, under certain conditions, VCT phasers may not reach a desired position, e.g., when camshaft phaser temperatures are higher than the oil sump temperature or when the VCT phasers are worn. Further, this condition may be exasperated when the oil pressure is set lower for fuel economy or to reduce parasitic loads. Reduced oil pressure may also reduce the phasing velocity of VCT phasers which may negatively affect engine response, turbo spool up time, and the ability to meet optimal Brake Specific Fuel Consumption due to engine breathing, for example. Thus, oil pressure supplied from engine oil lubrication system 200 may be increased after the spool valve has been adjusted to a threshold level in order to provide additional oil pressure to the phaser.

For example, as described below with regard to FIG. 5, the amount of oil pressure adjustment may be based on a position of the camshaft phaser, modeled, actual, and desired camshaft phasing rates, phaser temperature, oil sump temperature, phaser age, etc.

At 414, method 400 includes determining if a desired phasing position has been reached after a predetermined time interval. For example, a desired VCT position may be determined based on estimated engine operating conditions and/or various sensor readings.

If a desired phasing position has been reached at 414, method 400 proceeds to 422 to decrease the oil pressure. For example, oil pressure in the engine oil lubrication system may be decreased to a baseline level for fuel economy and to reduce parasitic loss associated with maintaining higher oil pressures in the system.

However, if the desired phasing position has not been reached at 414, method 400 proceeds to 416. At 416, method 400 includes determining if a pressure increase threshold has been reached. For example, oil pump 208 may have a threshold amount of pressure it can provide to the oil in engine oil lubrication system 200 so that no further pressure increases are possible.

If a pressure threshold has not been reached at 416, method 400 proceeds to 418. At 418, method 400 includes increasing an oil pressure supplied to the valve. As remarked above, increasing an oil pressure supplied to the valve may include adjusting the oil pressure in the engine oil lubrication system to adjust the amount of oil pressure supplied to the spool valve. In this example, the oil pressure supplied from engine oil lubrication system 200 may be increased after the spool valve has been adjusted to a threshold level in order to provide additional oil pressure to the phaser to assist the phaser in achieving a desired position. As another example, the oil pressure supplied from engine oil lubrication system 200 may be increased in concert with spool valve adjustments to provide additional oil pressure to the phaser to assist the phaser in achieving a desired position. As described below with regard to FIG. 5, the amount of oil pressure adjustment may be based on a position of the camshaft phaser, modeled, actual, and desired camshaft phasing rates, phaser temperature, oil sump temperature, phaser age, etc.

In some examples, method 400 may include continuing to monitor the phaser position and continuing to increase the oil pressure supplied to the valve until a desired position is reached or until a pressure threshold is reached.

If a desired position is not reached and an oil pressure threshold has been reached at 416, then method 420 proceeds to 420 to indicate camshaft phaser degradation. For example, an indication of degradation may be sent to an onboard diagnostic system to indicate that the VCT system is degraded. Oil pressure may then be decreased at 422 to a baseline value as described above.

In implementing the method of FIG. 4, reduced oil pressure may be maintained while still achieving VCT control. Under select conditions, the oil pressure may be increased to assist operation and returned to a baseline oil pressure. For example, the phaser spool valve may be used for VCT control with reduced oil pressure under nominal conditions. In situations where a camshaft phaser is degraded or oil sump temperature increases, oil pressure in the engine oil lubrication system may be temporarily increased to assist the phaser in achieving a desired position in a specified time frame.

Figure 5:
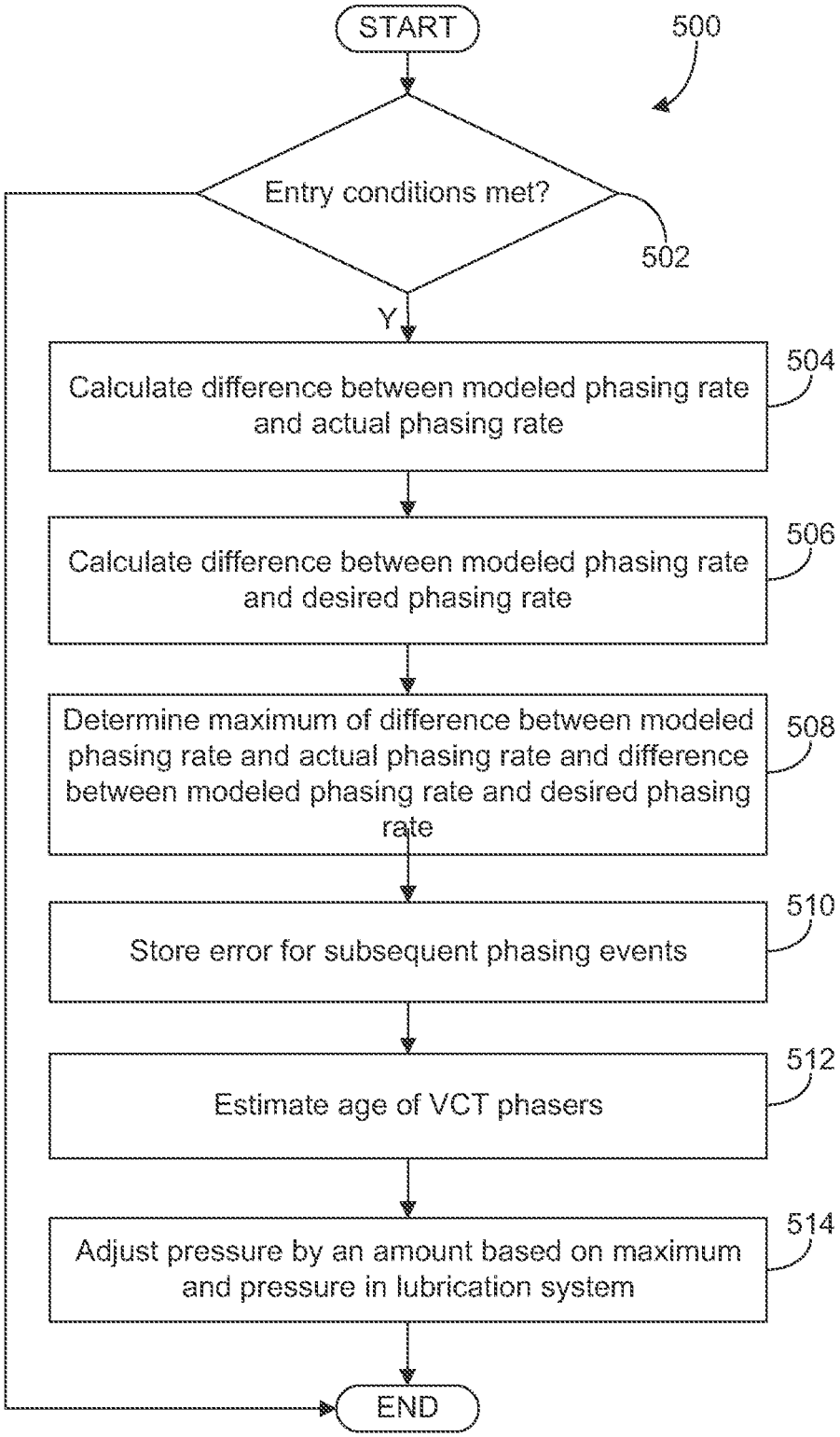
FIG. 5 shows an example method for determining an amount of pressure compensation for a variable valve timing system in accordance with the disclosure.

FIG. 5 shows an example method 500 for determining an amount of pressure compensation for a variable valve timing system and adjusting the oil pressure supplied to the spool valve accordingly.

At 502, method 500 includes determining if entry conditions are met for adjusting the oil pressure in an engine oil lubrication system. Entry conditions may include spool valve 300 adjusted to a threshold value, camshaft phaser temperature higher than an oil supply temperature, an age of a camshaft phaser greater than a threshold value, a camshaft phaser not reaching a desired position after an interval of time, etc.

At 504, method 500 includes calculating a difference between a modeled phasing rate and an actual phasing rate. For example, the actual phasing rate may be a phasing rate of the camshaft during a prior phasing event which is stored in a memory component of controller 12. The modeled phasing rate may be calculated based on various engine operating parameters such as engine load, engine RPM, etc. This difference gives an expected phasing rate error which may be used to adjust the oil pressure supplied to the valve to compensate for the error.

At 506, method 500 includes calculating a difference between a modeled phasing rate and a desired phasing rate to get a predicted phasing rate error. The desired phasing rate may be a predetermined value based on engine operating conditions and a configuration of the VCT system, e.g., determined by a rate of change of actuator position/cam timing based on a conversion, such as a calibratable table. This difference gives a predicted phasing rate error which may also be used to adjust the oil pressure supplied to the valve to compensate for the error.

At 508, method 500 includes taking a maximum of a difference between the modeled phasing rate and actual phasing rate and a difference between the modeled phasing rate and desired phasing rate in order to take into account both the errors determined in steps 504 and 506 described above. The adjustment of oil pressure supplied to the valve may then be based on this maximum.

At 510, method 500 includes storing the difference between the modeled phasing rate and actual phasing rate for use in adjusting an oil pressure supplied to the valve during a subsequent camshaft phasing event. In some examples, this error may be saved in a weighted additive manner for future use.

At 512, method 500 includes estimating an age of a camshaft phaser based on the difference between the modeled phasing rate and actual phasing rate. For example, a lookup table may be employed to estimate an age of the camshaft phasers based on one or more of the errors determined above. The estimated age of the camshaft phaser may be used during subsequent phasing events to predict an amount of additional oil pressure to supply to the phaser and adjust it accordingly. Further, the estimated age of the camshaft may be used for diagnostic purposes when indicating a degradation state of the phasers.

AT 514, method 500 includes adjusting the oil pressure supplied to the valve by an amount based on a pressure reading in an engine lubrication system in addition to the error terms determined in the actions described above. For example, this adjustment may depend on an amount of oil consumption by other oil subsystems coupled to the engine oil lubrication system together with one or a combination of the error terms determined above.

For example, the oil pressure may be adjusted based on the maximum of a difference between the modeled phasing rate and actual phasing rate and a difference between the modeled phasing rate and desired phasing rate in order to take into account both the errors determined in steps 504 and 506 described above. In this way, the oil pressure adjustment may be increased to take into account both error values obtained from previous phasing events and predicted error values based on current operating conditions such as engine load and RPM.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted.

Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be encoded as microprocessor instructions and stored into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, gasoline, diesel and other engine types and fuel types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. An engine method comprising:

in response to an operating condition, adjusting a valve coupled to a hydraulic variable camshaft timing actuator to initiate camshaft phasing of a camshaft and adjusting an oil pressure supplied to the valve based on a camshaft phaser position; and if a camshaft phaser locking pin is in a home position, reducing the oil pressure supplied to the valve for a predetermined time interval to a threshold amount to unlock the locking pin but not move a camshaft phaser and then increasing the oil pressure supplied to the valve to move the camshaft phaser.

2. The method of claim 1, wherein the oil pressure supplied to the valve is adjusted by an amount based on a modeled, actual, and desired camshaft phasing rate.

3. The method of claim 2, wherein the actual phasing rate is a phasing rate of the camshaft during a prior phasing event.

4. The method of claim 2, wherein the amount is determined by taking a maximum of a difference between the modeled phasing rate and actual phasing rate and a difference between the modeled phasing rate and desired phasing rate.

5. The method of claim 4, wherein the difference between the modeled phasing rate and actual phasing rate is used during a subsequent camshaft phasing event in adjusting an oil pressure supplied to the valve.

6. The method of claim 4, further comprising estimating an age of a camshaft phaser based on the difference between the modeled phasing rate and actual phasing rate and increasing oil pressure supplied to the valve based on an increase in the age.

7. The method of claim 1, wherein adjusting the oil pressure supplied to the valve based on the camshaft phaser position includes increasing the oil pressure supplied to the valve if a desired camshaft phaser position is not achieved after a predetermined time interval.

8. The method of claim 1, further comprising indicating camshaft phaser degradation if a desired camshaft phaser position is not achieved after a predetermined time interval subsequent to adjusting the oil pressure supplied to the valve.

9. The method of claim 1, wherein the oil pressure supplied to the valve is adjusted in response to the valve adjustment reaching a threshold.

10. The method of claim 1, further comprising increasing the oil pressure supplied to the valve when a camshaft phaser temperature is higher than an oil supply temperature.

11. The method of claim 1, wherein the oil pressure supplied to the valve is adjusted by an amount based on a pressure reading in an engine lubrication system.

12. The method of claim 1, wherein the valve is a hydraulic spool valve and adjusting the valve includes sending a control signal to a solenoid coupled to the hydraulic spool valve.

13. The method of claim 1, wherein the threshold amount is based on an area of the locking pin, a locking pin spring rate, an area of the camshaft phaser, a camshaft phaser spring rate, and a coefficient of camshaft friction.

14. The method of claim 1, wherein the oil pressure supplied to the valve is reduced to a predetermined amount in response to the camshaft phaser achieving a desired camshaft phase position.

15. An engine method comprising:

in response to an operating condition:

adjusting a valve coupled to a hydraulic variable camshaft timing actuator to initiate camshaft phasing;

if a camshaft phaser locking pin is in a home position, reducing an oil pressure supplied to the valve for a predetermined time interval to a threshold amount to unlock the locking pin but not move a camshaft phaser; and increasing the oil pressure supplied to the valve to move the camshaft phaser.

16. The method of claim 15, wherein the oil pressure supplied to the valve is increased by an amount determined by taking a maximum of a difference between amodeled phasing rate and an actual phasing rate and a difference between the modeled phasing rate and a desired phasing rate.

17. The method of claim 15, further comprising increasing the oil pressure supplied to the valve by an additional amount if a desired camshaft phaser position is not achieved after the predetermined time interval and the valve adjustment reaches a threshold value.

18. An engine method comprising:

in response to an operating condition, adjusting a valve coupled to a hydraulic variable camshaft timing actuator to initiate camshaft phasing and reducing an oil pressure supplied to the valve for a predetermined time interval to a threshold amount to unlock a locking pin but not move a camshaft phaser.

19. The method of claim 18, wherein the threshold amount is based on an area of the locking pin, a locking pin spring rate, an area of the camshaft phaser, a camshaft phaser spring rate, and a coefficient of camshaft friction.

* * * * *